US009938790B2

(12) United States Patent
Yang

(10) Patent No.: US 9,938,790 B2
(45) Date of Patent: Apr. 10, 2018

(54) PETROLEUM INSTRUMENT HOISTING SYSTEM AND HOISTING HEAD

(71) Applicant: Beijing Hailan Science & Technology Development Co., Ltd., Beijing (CN)

(72) Inventor: Biao Yang, Beijing (CN)

(73) Assignee: BEIJING HAILAN SCIENCE & TECHNOLOGY DEVELOPMENT CO., LTD., Beijing (CN)

( * ) Notice: Subject to any disclaimer, the term of this patent is extended or adjusted under 35 U.S.C. 154(b) by 246 days.

(21) Appl. No.: 14/919,015

(22) Filed: Oct. 21, 2015

(65) Prior Publication Data

US 2016/0115756 A1 Apr. 28, 2016

(30) Foreign Application Priority Data

Oct. 23, 2014 (CN) ..... 2014 1 0571832

(51) Int. Cl.
*E21B 31/20* (2006.01)
*E21B 31/12* (2006.01)
(Continued)

(52) U.S. Cl.
CPC ..... *E21B 31/20* (2013.01); *E21B 19/22* (2013.01); *E21B 23/14* (2013.01); *E21B 31/125* (2013.01)

(58) Field of Classification Search
CPC ..... E21B 31/20; E21B 31/125; E21B 19/22; E21B 23/14
See application file for complete search history.

(56) References Cited

U.S. PATENT DOCUMENTS 1,396,260 A 11/1921 Davis
1,445,581 A * 2/1923 Fullop ..... E21B 31/20 294/86.2
(Continued)

FOREIGN PATENT DOCUMENTS

CN 2141461 Y 9/1993
CN 2192718 Y 3/1995
(Continued)

*Primary Examiner* — Matthew R Buck
*Assistant Examiner* — Aaron L Lembo
(74) *Attorney, Agent, or Firm* — K&L Gates LLP

(57) ABSTRACT

The present invention discloses a petroleum instrument hoisting system and a hoisting head, which is used for hoisting a petroleum instrument. The hoisting head includes: a lifting part, for connecting a lifting rope; an insertion rod, which is located under the lifting part and used for protruding into a stair-shaped hoisting hole, and is set with a notch on both sides thereof; a insertion head, which is connected with the insertion rod via a connecting rod, wherein the insertion rod is set with a slide opening that is in sliding fit with the connecting rod, and the lateral surface of one end of the insertion rod that is adjacent to the connecting rod is a conical surface; a coniform extension spring, which is sleeved on the insertion rod and the connecting rod, wherein one end thereof with a large cross-sectional area is sleeved on the insertion rod, and the other end thereof with a small cross-sectional area is sleeved on the connecting rod and is fixed relative to the connecting rod; two clamping pieces, which are respectively hinged in two notches, and the clamping face thereof can be in hooking fit with a hooking face in the horizontal plane; two pulling ropes, which are respectively connected with the other end of the corresponding clamping piece, and the orientations of the other ends, which are connected with the pulling ropes, of the two clamping pieces are opposite to each other. By the above
(Continued)

solution, the hoisting of a petroleum instrument can be solved.

17 Claims, 3 Drawing Sheets

(51) Int. Cl.
*E21B 23/14* (2006.01)
*E21B 19/22* (2006.01)

(56) References Cited

U.S. PATENT DOCUMENTS

| | | | | | |
|---|---|---|---|---|---|
| 1,645,042 | A * | 10/1927 | Claypoole | E21B 31/20 | 294/86.16 |
| 2,732,901 | A * | 1/1956 | Davis | E21B 23/04 | 166/137 |
| 2004/0262005 | A1 | 12/2004 | Harmon et al. | | |
| 2016/0115757 | A1* | 4/2016 | Yang | E21B 31/20 | 166/75.11 |
| 2016/0115758 | A1* | 4/2016 | Yang | E21B 23/14 | 403/376 |
| 2017/0122053 | A1* | 5/2017 | Braddick | E21B 31/20 | |

FOREIGN PATENT DOCUMENTS

| | | | |
|---|---|---|---|
| CN | 2864083 | Y | 1/2007 |
| CN | 104405303 | A | 3/2015 |
| GB | 525002 | A | 8/1940 |
| GB | 2280459 | A | 2/1995 |

* cited by examiner

PETROLEUM INSTRUMENT HOISTING SYSTEM AND HOISTING HEAD

CROSS REFERENCE TO RELATED APPLICATION

This application claims priority under 35 U.S.C. § 119(a) to Chinese Patent Application Number 201410571832.9, filed on Oct. 23, 2014, the disclosure of which is incorporated herein by reference in its entirety.

FIELD OF THE INVENTION

The present invention relates to the field of petroleum instrument hoisting technologies, and in particular, to a petroleum instrument hoisting system and a hoisting head.

BACKGROUND OF THE INVENTION

During petroleum drilling, as the drill rod of a drilling device strikes into the earth gradually, a petroleum instrument (for example, inclinometer) set in the chamber of the drill rod will transmit the detected data to the ground successively, thereby the subsequent processing on the detected data may be realized by a ground device. As the drilling depth increases gradually, the position of the petroleum instrument will be deeper and deeper. It is known that the environment inside a drilling well is severe and it is harmful to the petroleum instrument. Therefore, it often occurs that the petroleum instrument is damaged; correspondingly, it also often occurs that the petroleum instrument is examined and repaired or replaced.

Generally, the petroleum instrument is placed on a base in the chamber of the drill rod. At present, once the petroleum instrument is damaged, it will be required that the drill rods should be pulled out of the drilling well, that is, the drill rods should be salvaged one by one, until the drill rod in which the petroleum instrument exists is salvaged, and then the petroleum instrument is replaced or examined and repaired. After the petroleum instrument is replaced or examined and repaired, it needs to be reinstalled into the corresponding probe, and then each drill rod should be reconnected to successively lower the drill rod into the drilling well. In the above mode of replacing or examining and repairing the petroleum instrument, each drill rod needs to be raised to the ground for disassembly, thereby the labor intensity will be large and the efficiency will be low. Drilling must be stopped when the drill rods are pulled out of the drilling well, thus the drilling progress will be delayed, and at the same time, the cost for replacing or examining and repairing the petroleum instrument will be added. For users with a drilling progress task, the economic loss caused by pulling drill rods out of the drilling well will be greater. For example, at present, one subsegment of the drill rod is 10 m long, and three 10 m subsegments form one macrosegment; when the petroleum instrument is made at a position of 3000 m by drilling the drill rod, if it is damaged, 100 macrosegments of drill rods need to be successively salvaged during pulling drill rods out of the drilling well, and this will at least cost 2-3 days, and manual work is required to disassemble the drill rods. For important drilling, it goes without saying that a huge economic loss will be caused by examining and repairing or replacing the petroleum instrument via pulling drill rods out of the drilling well. Therefore, the present inventor provides a salvaging device in a related patent application, by which the salvage of a petroleum instrument can be realized. In such a case, it only needs to salvage the petroleum instrument to the ground, without pulling drill rods out of the drilling well; thereby, the above problem can be solved. However, by the above salvaging device, only the salvage problem can be solved, and those skilled in the art are beset all the time by how to reinstall the petroleum instrument salvaged via the salvaging device onto a preset position inside the chamber of the drill rod after examining and repairing or replacing. For the petroleum instrument that needs to be relocated at the original position under the drilling well, if the installation problem of the petroleum instrument cannot be solved, the problem of larger labor intensity, low efficiency, high examining and repairing or replacing cost and great economic loss due to stopping drilling during the examining and repairing or replacing of the petroleum instrument will still be unable to be solved fundamentally.

SUMMARY OF THE INVENTION

In one aspect of the invention, there provides a hoisting head for a petroleum instrument hoisting system, thereby solving the current problem of relocating a petroleum instrument salvaged to the ground after examining and repairing or replacing.

In order to solve the above technical problem, the invention provides the following technical solutions:

A hoisting head for a petroleum instrument hoisting system, which is adopted to hoisting a petroleum instrument, wherein the petroleum instrument has a stair-shaped hoisting hole, and the stair face of the stair-shaped hoisting hole is a hooking face; the hoisting head includes:

a lifting part, for connecting a lifting rope;

an insertion rod, which is located under the lifting part and used for protruding into the stair-shaped hoisting hole, and is set with a notch on both sides thereof;

an insertion head, which is connected with the insertion rod via a connecting rod, wherein the insertion rod is set with a slide opening that is in sliding fit with the connecting rod, and the lateral surface of one end of the insertion rod that is adjacent to the connecting rod is a conical surface;

a coniform extension spring, which is sleeved on the insertion rod and the connecting rod, wherein one end thereof with a large cross-sectional area is sleeved on the insertion rod, and the other end thereof with a small cross-sectional area is sleeved on the connecting rod and is fixed relative to the connecting rod, and when the coniform extension spring is in a compression state, two clamping pieces will be driven in a retraction state, and the external dimension of the two clamping pieces in retraction state is smaller than the diameter of the hole section of the stair-shaped hoisting hole that has a small diameter;

two clamping pieces, which are respectively hinged in the two notches, and the clamping face can be in hooking fit with the hooking face in the horizontal plane, and the hinge part of the two clamping pieces is located on one end thereof; and two pulling ropes, which are respectively connected with the other end of the corresponding clamping piece, wherein the pulling rope is strained gradually as the clamping face rotates to the horizontal plane, and the orientations of the other ends, which are connected with the pulling rope, of the two clamping pieces are opposite to each other.

Preferably, in the above hoisting head, an intermediate jointing part is further included between the lifting part and the insertion rod; and the cross-sectional areas of the lifting part, the intermediate jointing part and the insertion rod decrease gradually to form a stair-shaped structure.

Preferably, in the above hoisting head, the lifting part, the intermediate jointing part and the insertion rod form an integral structure.

Preferably, in the above hoisting head, the intermediate jointing part is set with a first through hole and a second through hole, and the first through hole and the second through hole intersect with each other;

the first through hole is set with a cross rod that traverses the intermediate jointing part, the pulling rope passes through the openings of the second through hole that are located on the same side and is connected fixedly with the cross rod, and the cross rod can be in stopping fit with an entrance end of the stair-shaped hoisting hole.

Preferably, in the above hoisting head, the sidewall of the notch is set with a through hole that extends to the surface of the insertion rod, and one end of the pulling rope that is connected with the clamping piece passes through the through hole.

Preferably, in the above hoisting head, the free end of the insertion head is a coniform end.

Preferably, in the above hoisting head, the surface of the lifting part is set with a plurality of crash-proof strips that are distributed circumferentially;

the two ends of the crash-proof strip are fixed on the lifting part, and the part of the crash-proof strip, which is located between the two ends thereof, and the surface of the lifting part form a buffer clearance.

Preferably, in the above hoisting head, the crash-proof strip is a beryllium copper crash-proof strip.

A petroleum instrument hoisting system, including a rope winder, a lifting rope and a hoisting head; wherein, one end of the lifting rope is wound on the rope winder, and the other end is connected with the hoisting head; and the hoisting head is any one of the above hoisting heads.

Preferably, in the above petroleum instrument hoisting system, the lifting rope is a nylon rope.

The working process of the hoisting head for a petroleum instrument hoisting system according to the invention is as follows: the insertion head of the hoisting head protrudes into the stair-shaped hoisting hole from the opening of the stair-shaped hoisting hole, and as the insertion rod gradually strikes into the stair-shaped hoisting hole, the clamping pieces set on the insertion rod retract gradually as interfered by the hole section of the stair-shaped hoisting hole that has a small diameter and will finally be in a retraction state; when the two clamping pieces are in a retraction state, the transverse dimension of the whole hoisting head reaches its minimum value, and it can pass through the hole section of the stair-shaped hoisting hole that has a small diameter, and when the clamping pieces enter into the hole section of the stair-shaped hoisting hole that has a large diameter, the ends of the clamping pieces that are connected with the pulling rope fall back under the action of gravity, thereby the two clamping pieces will be again in open state, the clamping face of the clamping pieces will be in the horizontal plane, and at this time, the pulling rope will be in strained state, and the clamping face of the clamping pieces will be in hooking fit with a hooking face, thereby the hoisting head will be in hooking fit with the petroleum instrument. The lifting rope of the petroleum instrument hoisting system drives the hoisting head to lower along the chamber of the drill rod, and when the petroleum instrument is placed at the designated position, the petroleum instrument will be placed on the mounting base, and at this time, it continues to lower the lifting rope to finally make the insertion head contact the bottom of the stair-shaped hoisting hole. As it continues to lower the lifting rope, the gravity of the whole hoisting head makes more parts of the connecting rod slide into the slide opening of the insertion rod, and in this process, the coniform extension spring is in a compression state, and the compression of the coniform extension spring makes the part thereof, which fits the conical surface on the insertion rod, move to the direction with larger transverse dimension, thereby the whole coniform extension spring is driven to move to the direction approaching the clamping piece, and finally the coniform extension spring will jack up the ends of the clamping pieces that are connected with the pulling rope, thereby the two clamping pieces will be made in retraction state, which makes the clamping face of the clamping pieces detach from the hooking face, and the whole hoisting head is separated from the petroleum instrument as driven by the lifting rope, thereby separation from the petroleum instrument is realized.

It may be seen from the above working process that, by using the hoisting head according to the invention, the problem of relocating a petroleum instrument salvaged to the ground after examining and repairing or replacing can be solved, that is, the installation problem of a petroleum instrument salvaged to the ground can be solved.

BRIEF DESCRIPTION OF THE DRAWINGS

In order to more clearly illustrate the technical solutions of the embodiments of the invention, the drawings needed in the description of the embodiments will be briefly introduced below. Apparently, other drawings may also be obtained by one of ordinary skills in the art according to these drawings without creative work.

In FIG. 1-FIG. 5, the clamping piece 26 is in a retraction state.

In the above FIG. 1-FIG. 5:

Petroleum Instrument 1, Hoisting Head 2, Rope Winder 3, Lifting Rope 4, Pulley Block 5, Drilling Well 6

Stair-Shaped Hoisting Hole 11, Coniform Opening 111, Hooking Face 112, Lifting Part 21, Insertion Rod 22, Notch 221, Conical Surface 222, Through hole 223, Insertion Head 23, Coniform End 231, Connecting Rod 24, Coniform Extension spring 25, Clamping Piece 26, Pulling Rope 27, Pulling Rope 28, Intermediate Jointing Part 29, First Through hole 291, Second Through hole 292, Cross Rod 210, Crash-Proof Strip 211, Buffer Clearance 212

DETAILED DESCRIPTION OF THE EMBODIMENTS

The embodiments of the invention provide a hoisting head for a petroleum instrument hoisting system, thereby solving the current problem of relocating a petroleum instrument salvaged to the ground after examining and repairing or replacing.

In order to make one skilled in the art better understand the technical solutions in the embodiments of the invention and to make the above objects, characteristics and advantages of the embodiments of the invention more apparent, the technical solutions in the embodiments of the invention will be further illustrated in detail in conjunction with the drawings.

Figure 1:
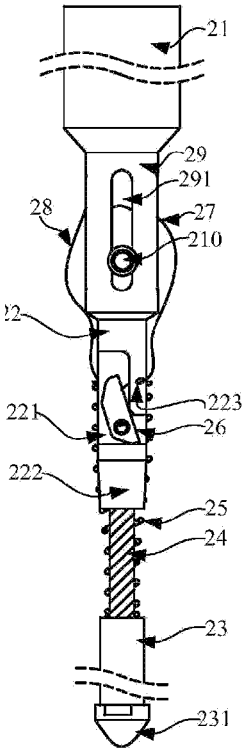
FIG. 1 is a structural representation of a hoisting head for a petroleum instrument hoisting system according to one embodiment of the invention.
Figure 2:
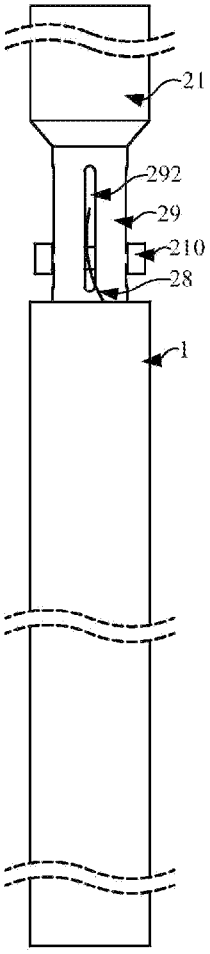
FIG. 2 is a structural representation showing the fitting of a hoisting head for a petroleum instrument hoisting system according to one embodiment of the invention with a petroleum instrument.
Figure 3:
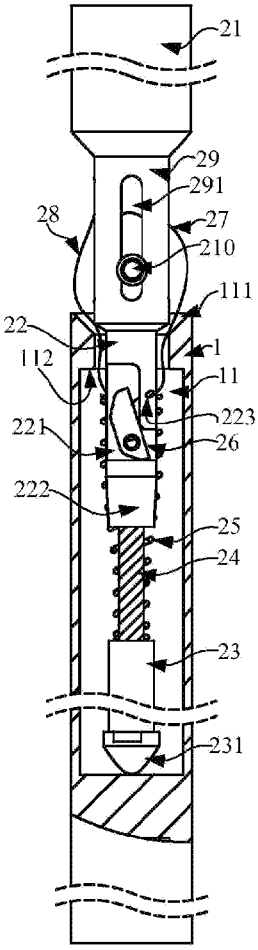
FIG. 3 is a partial cut-away view of FIG. 2 at another visual angle.
Figure 4:
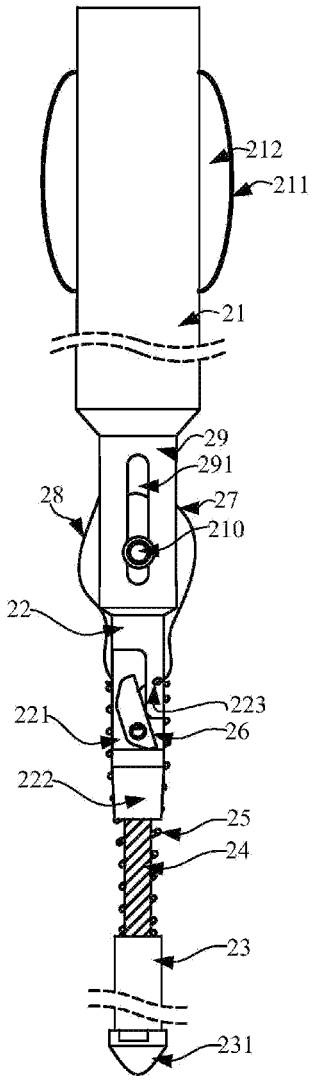
FIG. 4 is another structural representation of the hoisting head for a petroleum instrument hoisting system according to one embodiment of the invention.

Referring to FIGS. 1-3, one embodiment of the invention provides a hoisting head 2 for a petroleum instrument hoisting system. The hoisting head 2 is used for hoisting a petroleum instrument 1. The petroleum instrument 1 has a stair-shaped hoisting hole 11, and the stair-shaped hoisting hole 11 is generally located on the top of the petroleum instrument 1 for realizing the subsequent hoisting and mounting. The stair face of the stair-shaped hoisting hole 11 is a hooking face 112, that is, a hole section of the stair-shaped hoisting hole 11 that has a small diameter is located at the top opening of the petroleum instrument 1, the hole section that has a large diameter is located under the top opening, and the hooking face 112 faces the bottom of the hole section that has a large diameter. The hoisting head 2 according to the embodiment of the invention includes a lifting part 21, an insertion rod 22, an insertion head 23, a coniform extension spring 25, a connecting rod 24, two clamping pieces 26 and two pulling ropes (pulling rope 27, pulling rope 28).

Wherein, the lifting part 21 is a connection part for the whole hoisting head 2 and the lifting rope of the petroleum instrument hoisting system, and the lifting part 21 drives the whole hoisting head 2 to rise and fall under the pulling of the lifting rope. Generally, the lifting part 21 has a cylindrical structure; however, the specific shape of the lifting part 21 is not limited in the embodiment of the invention, and the lifting part 21 may have various shapes so long as it guarantees that the lifting part 21 can rise and fall in the chamber of the drill rod.

The insertion rod 22 is located under the lifting part 21, and it is used for protruding into the stair-shaped hoisting hole 11. Generally, the insertion rod 22 has a cylindrical structure. When the insertion rod 22 and the lifting part 21 both have a cylindrical structure, it is preferred that the insertion rod 22 and the lifting part 21 are arranged coaxially. The insertion rod 22 and the lifting part 21 may be connected by an additional intermediate connecting member, or they may form an integral structure. It should be noted that, in the embodiment of the invention, the insertion rod 22 is used to protrude into the stair-shaped hoisting hole 11 so as to realize the hooking fit with the hooking face 112 of the stair-shaped hoisting hole 11, thus the insertion rod 22 needs to have an enough length, and one skilled in the art may adaptively adjust and design the length of the insertion rod 22 according to the type and size of the petroleum instrument 1, which will not be limited in the embodiments of the invention. In the embodiment of the invention, a notch 221 is set in both sides of the free end of the insertion rod 22.

The insertion head 23 is connected with the insertion rod 22 via a connecting rod 24; specifically, the insertion rod 22 is set with a slide opening that is in sliding fit with the connecting rod 24, one end of the connecting rod 24 protrudes into the slide opening and is in sliding fit with the slide opening, and the other end is connected fixedly with the insertion head 23. The lateral surface of one end of the insertion rod 22 that is adjacent to the connecting rod 24 is a conical surface 222.

The coniform extension spring 25 is sleeved on the insertion rod 22 and the connecting rod 24, wherein one end thereof with a large cross-sectional area is sleeved on the insertion rod 22, and the other end thereof with a small cross-sectional area is sleeved on the connecting rod 24 and is fixed relative to the connecting rod 24.

Two clamping pieces 26 are respectively hinged in the two notches 221, and the clamping face of the clamping pieces 26 can be in hooking fit with the hooking face 112 in the horizontal plane, the hinge parts of the two clamping pieces 26 are both located at one end thereof. Preferably, the two clamping pieces 26 are hinged in the corresponding notch 221 thereof via one and the same jointed shaft inserted in the insertion rod 22. The pulling rope 27 is connected with the other end of one clamping piece 26, and the pulling rope 28 is connected with the other end of the other clamping piece 26. The pulling rope can be strained gradually as the clamping face of the clamping piece 26 rotates to the horizontal plane, and the orientations of the other ends of the two clamping pieces, which are connected with the pulling ropes, are opposite to each other, so that it may be in better hooking fit with the hooking face 112 when the clamping face is in the horizontal plane. More preferably, the hoisting head 2 according to one embodiment of the invention further includes two compression reset spring, which are arranged in the corresponding notch with a one-to-one correspondence. The compression reset spring is set between the other end of the clamping piece 26 (that is, a non-hinged end relative to the hinged end, i.e., the end connected with the pulling rope) and the sidewall of the corresponding notch. More preferably, the pulling rope passes through the corresponding compression reset spring so as to improve the extension and compression stability of the compression reset spring. In one preferred solution of the embodiment of the invention, the setting of the compression reset spring can assist the clamping piece 26 to fall back, so that the two clamping pieces 26, which falls back under the action of gravity, may fall back at a faster speed, thereby it may turn to an open state more easily.

In the embodiment of the invention, when the coniform extension spring 25 is in a compression state, the two clamping pieces 26 can be driven in a retraction state, and the external dimension of the two clamping pieces 26 in retraction state is smaller than the diameter of the hole section of the stair-shaped hoisting hole 11 that has a small diameter, so that it can guarantee that the clamping face of the clamping piece 26 is separated from the hooking face 112 of the stair-shaped hoisting hole 11 when the coniform extension spring 25 is in a compression state, thereby it may guarantee that the whole hoisting head 2 is in a free hoisting state in the axial direction of the stair-shaped hoisting hole 11. When it is made in a compression state by the coniform structure of the coniform extension spring 25, the part that corresponds to the conical surface 222 of the insertion rod 22 moves upward, thereby the whole coniform extension spring 25 is made to move to the part adjacent to the clamping piece 26 and finally lock the clamping piece 26 to prevent it from opening, that is, keep the two clamping pieces 26 in retraction state.

The working process of the hoisting head for a petroleum instrument hoisting system according to the embodiment of the invention is as follows: the insertion head 23 of the hoisting head 2 protrudes into the stair-shaped hoisting hole 11 from the opening of the stair-shaped hoisting hole 11, and as the insertion rod 22 gradually strikes into the stair-shaped hoisting hole, the clamping pieces 26 set on the insertion rod 22 retract gradually as interfered by the hole section of the stair-shaped hoisting hole 11 that has a small diameter and will finally be in a retraction state; when the two clamping pieces 26 are in a retraction state, the transverse dimension of the whole hoisting head 2 reaches its minimum value, and it can pass through the hole section of the stair-shaped hoisting hole 11 that has a small diameter, and when the clamping pieces 26 enter into the hole section of the stair-shaped hoisting hole 11 that has a large diameter, the ends of the clamping pieces 26 that are connected with the pulling rope fall back under the action of gravity, thereby the two clamping pieces 26 will be again in open state, the clamping face of the clamping pieces 26 will be in the horizontal plane, and at this time, the pulling rope will be in strained state, and the clamping face of the clamping pieces will be in hooking fit with a hooking face 112, thereby the hoisting head 2 will be in hooking fit with the petroleum instrument 1. The lifting rope of the petroleum instrument hoisting system drives the hoisting head 2 to lower along the chamber of the drill rod, and when the petroleum instrument 1 is placed at the designated position, the petroleum instrument 1 will be placed on the mounting base, and at this time, it continues to lower the lifting rope to finally make the insertion head 23 contact the bottom of the stair-shaped hoisting hole 11. As it continues to lower the lifting rope, the gravity of the whole hoisting head 2 makes more parts of the connecting rod 24 slide into the slide opening of the insertion rod 22, and in this process, the coniform extension spring 25 is in a compression state, and the compression of the coniform extension spring 25 makes the part thereof, which fits the conical surface 222 on the insertion rod 22, move to the direction with larger transverse dimension, thereby the whole coniform extension spring 25 is driven to move to the direction approaching the clamping piece 26, and finally the coniform extension spring 25 will jack up the ends of the clamping pieces 26 that are connected with the pulling rope, thereby the two clamping pieces 26 will be made in retraction state, which makes the clamping face of the clamping pieces 26 detach from the hooking face 112, and the whole hoisting head 2 is separated from the petroleum instrument 1 as driven by the lifting rope, thereby separation from the petroleum instrument 1 is realized.

It may be seen from the above working process that, by using the hoisting head according to the embodiment of the invention, the problem of relocating a petroleum instrument salvaged to the ground after examining and repairing or replacing can be solved, that is, the mounting of a petroleum instrument salvaged to the ground can be solved.

Referring to FIG. 1, in the hoisting head 2 according to one embodiment of the invention, an intermediate jointing part 29 is further included between the lifting part 21 and the insertion rod 22. Wherein, the cross sections of the lifting part 21, the intermediate jointing part 29 and the insertion rod 22 decrease gradually to form a stair-shaped structure, which can improve the work sensitivity of the hoisting head 2.

In the embodiment of the invention, the pulling rope 27 and the pulling rope 28 may be fixed on the hoisting head 2 in various modes. For example, the pulling rope 27 and the pulling rope 28 are directly hooked on the lifting part 21, the insertion rod 22 or the intermediate jointing part 29. Referring again to FIGS. 1 and 2, the intermediate jointing part 29 is set with a first through hole 291 and a second through hole 292, which intersect with each other. The first through hole 291 is set with a cross rod 210 that traverses the intermediate jointing part 29, and the pulling rope 27 and the pulling rope 28 pass through the openings of the second through hole 292 that are located on the same side and is connected fixedly with the cross rod 210. More preferably, the length of the cross rod 210 is greater than the entrance width of the stair-shaped hoisting hole 11, so that it can be in stopping fit with the entrance end of the stair-shaped hoisting hole 11. The cross rod 210 is in stopping fit with the entrance end of the stair-shaped hoisting hole 11, thereby it may guarantee that, under the premise that the two clamping pieces 26 enter the hole section of the stair-shaped hoisting hole 11 that has a large diameter, the insertion rod 22 can be prevented from further protruding into a deeper part of the stair-shaped hoisting hole 11, and finally, unnecessary operations can be avoided, and the time for salvaging can be saved. Preferably, the above first through hole 291 and second through hole 292 are strip-shaped holes extending along the axial direction of the lifting part 21, the insertion rod 22 or the intermediate jointing part 29, and the cross rod 210 is in sliding fit with the second through hole 292; during the process in which the insertion rod 22 of the whole hoisting head 2 is inserted into the stair-shaped hoisting hole 11, the cross rod 210 slides as interfered by the petroleum instrument 1, and finally it will be in stopping fit with the stair-shaped hoisting hole 11 on the top of the second through hole 292. The cross rod 22 can slide in the length direction of the second through hole 292, thus the length of the whole hoisting head 2 that enters into the stair-shaped hoisting hole 11 can be changed, thereby the depth adaptability of the hoisting head 2 to the stair-shaped hoisting hole 11 can be improved.

In the embodiment of the invention, the sidewalls of the two notches are both set with a through hole 223 that extends to the surface of the insertion rod 22, and one end of the pulling rope that is connected with the clamping piece 26 passes through the through hole 223. The setting of the through hole 223 can decrease the arrangement space of the pulling rope.

The insertion rod 22 is used for inserting into the stair-shaped hoisting hole 11. The accurate and fast insertion of the insertion rod 22 is an important ensurance to the salvaging efficiency. Therefore, in the embodiment of the invention, the free end, i.e., the insertion end, of the insertion head 23 has a coniform end 231. However, the entrance of the stair-shaped hoisting hole 11 may be designed as a coniform opening 111 for accurate and rapid insertion of the insertion rod 22.

During the process in which the petroleum instrument 1 is hoisted downward along the chamber of the drill rod, the lifting rope of the petroleum instrument hoisting system drives the whole hoisting head 2 to lower along the chamber of the drill rod, and in this process, the hoisting head 2 may swing and thus impact the drill rod, which tends to damage the drill rod. In order to solve this problem, in the hoisting head 2 according to the embodiment of the invention, a plurality of crash-proof strips 211 that are distributed circumferentially are set on the surface of the lifting part 21, and preferably, the crash-proof strips 211 are elastic strips so as to attain the object of damping and lowering the impact force. Specifically, the two ends of the crash-proof strips 211 are fixed on the lifting part 21, and the part of the crash-proof strip 211, which is located between the two ends thereof, and the surface of the lifting part 21 form a buffer clearance 212 so as to attain the object of damping. Additionally, during impacting, the collision between the hoisting head 2 and the inner wall of the chamber of the drill rod tends to generate sparks, which is a severe hidden danger to petroleum drilling. Therefore, the crash-proof strip 211 according to the embodiment of the invention is a beryllium copper crash-proof strip, which is made of a beryllium copper material and has good flame resistance, thereby hidden danger may be lowered.

Figure 5:
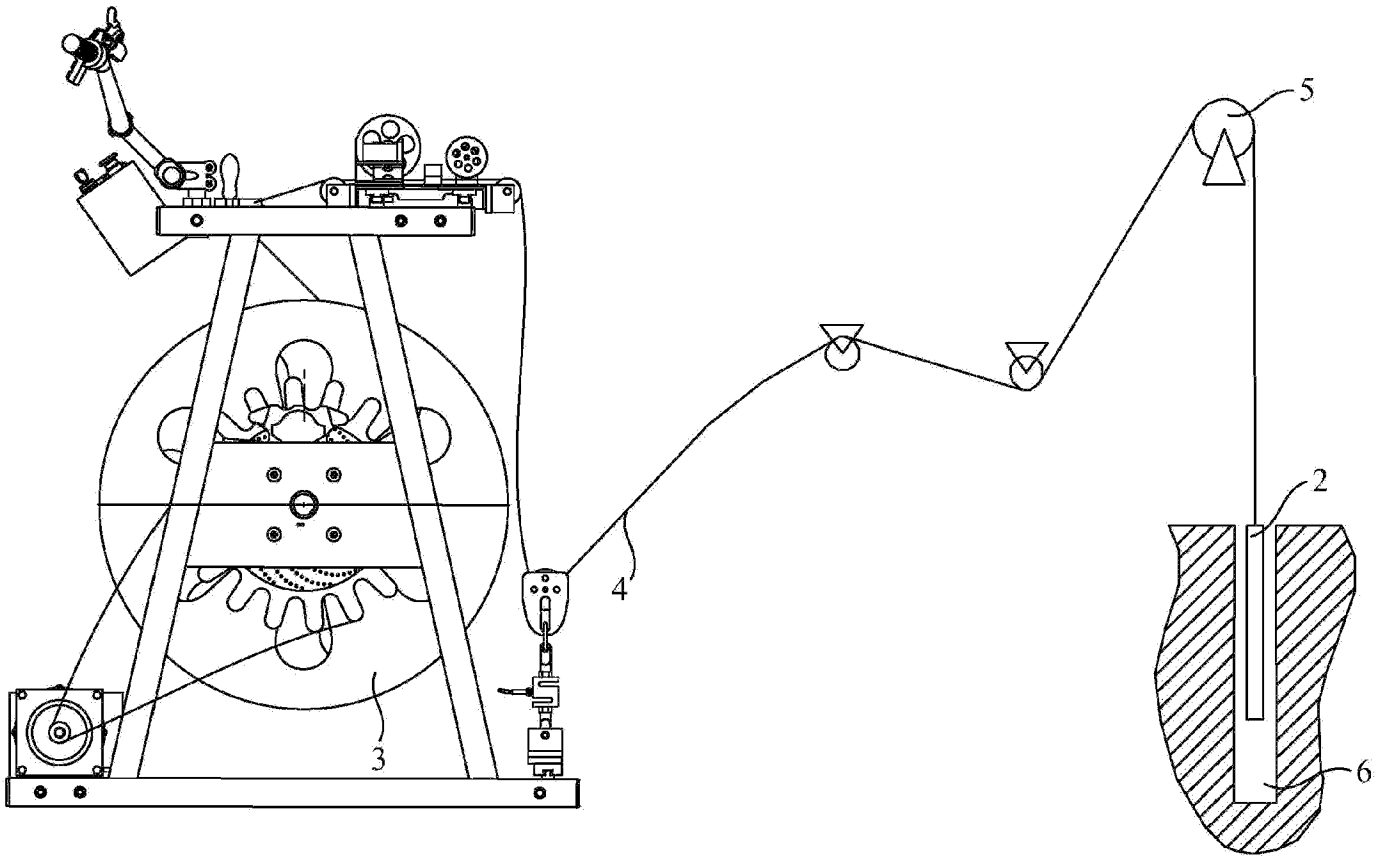
FIG. 5 is a structural representation of a petroleum instrument hoisting system according to one embodiment of the invention.

Based on the hoisting head according to the embodiment of the invention, one embodiment of the invention further provides a petroleum instrument hoisting system. Referring to FIG. 5, the petroleum instrument hoisting system includes a rope winder 3, a lifting rope 4 and a hoisting head 2, wherein, one end of the lifting rope 4 is wound on the rope winder 3, and the other end is connected with the hoisting head 2, thereby the hoisting head 2 can rise and fall in the drilling well 6. Wherein, the hoisting head 2 is the hoisting head 2 according to any one of the above embodiments. Generally, the strike direction of the lifting rope 4 is changed via a pulley block 5, thereby the winder 3 may work at different arrangement positions.

During hoisting, the lifting rope 4 drives the hoisting head 2 to rise and fall. Generally, the lifting rope 4 is a steel wire rope; however, the steel wire rope may be knotted, and the fatigue caused by knotting tends to make the lifting rope 4 broken. Once the lifting rope 4 is broken, severe damage will be caused to the drilling device. Therefore, the lifting rope 4 according to the embodiment of the invention is preferably a flexible lifting rope, for example, a nylon rope. The flexible lifting rope has a high strength and a strong flexibility, and it will not be knotted during lifting, thereby the probability that the lifting rope 4 is broken can be lowered. The flexible lifting rope is generally made of a material with high strength and good abrasion resistance, which is not limited in the embodiments of the invention.

It should be noted that, the hoisting head and the petroleum instrument hoisting system according to the embodiments of the invention may also be applicable for the hoisting of an instrument under a drilling well during the drilling process of other fields, for example, coal drilling, etc., rather than being limited to the field of petroleum.

Each embodiment in this specification is described in a stepped mode, and reference may be made to each other for the same or similar parts among the embodiments. Each embodiment emphasizes a different part from other embodiments.

The above embodiments of the invention will not limit the protection scope of the invention. Any modifications, equivalent substitutions and improvements without departing from the spirit and principle of the invention will fall into the protection scope of the invention.

What is claimed is:

1. A hoisting head (2) for a petroleum instrument hoisting system, which is used for the hoisting of a petroleum instrument (1), the petroleum instrument (1) has a stair-shaped hoisting hole (11), and the stair face of the stair-shaped hoisting hole (11) is a hooking face (112); wherein, the hoisting head (2) comprises:

a lifting part (21), for connecting a lifting rope;

an insertion rod (22), which is located under the lifting part (21) and used for protruding into the stair-shaped hoisting hole (11), and is set with a notch (221) on both sides thereof;

an insertion head (23), which is connected with the insertion rod (22) via a connecting rod (24), wherein the insertion rod (22) is set with a slide opening that is in sliding fit with the connecting rod (24), and the lateral surface of one end of the insertion rod (22) that is adjacent to the connecting rod (24) is a conical surface (222);

two clamping pieces (26), which are respectively hinged in the two notches (221), and the clamping face of the clamping pieces can be in hooking fit with the hooking face (112) in the horizontal plane, and the hinge part of the two clamping pieces (26) is located on one end thereof;

a coniform extension spring (25), which is sleeved on the insertion rod (22) and the connecting rod (24), wherein one end thereof with a large cross-sectional area is sleeved on the insertion rod (22), and the other end thereof with a small cross-sectional area is sleeved on the connecting rod (24) and is fixed relative to the connecting rod (24), wherein when the coniform extension spring (25) is in a compression state, the two clamping pieces (26) are driven in a retraction state, and the external dimension of the two clamping pieces (26) in retraction state is smaller than the diameter of the hole section of the stair-shaped hoisting hole (11) that has a small diameter; and two pulling ropes (27, 28), which are respectively connected with the other end of the corresponding clamping piece (26), wherein the pulling rope (27 or 28) is strained gradually as the clamping face rotates to the horizontal plane, and the orientations of the other ends, which are connected with the pulling rope (27 or 28), of the two clamping pieces (26) are opposite to each other.

2. The hoisting head (2) according to claim 1, wherein, an intermediate jointing part (29) is further included between the lifting part (21) and the insertion rod (22); and the cross-sectional areas of the lifting part (21), the intermediate jointing part (29) and the insertion rod (22) decrease gradually to form a stair-shaped structure.

3. The hoisting head (2) according to claim 2, wherein, the lifting part (21), the intermediate jointing part (29) and the insertion rod (22) form an integral structure.

4. The hoisting head (2) according to claim 2, wherein, the intermediate jointing part (29) is set with a first through hole (291) and a second through hole (292), and the first through hole (291) and the second through hole (292) intersect with each other;

the first through hole (291) is set with a cross rod (210) that traverses the intermediate jointing part (29), the pulling rope (27 or 28) passes through the openings of the second through hole (292) that are located on the same side and is connected fixedly with the cross rod (210), and the cross rod (210) can be in stopping fit with the entrance end of the stair-shaped hoisting hole (11).

5. The hoisting head (2) according to claim 1, wherein, the sidewall of the notch (221) is set with a through hole (223) that extends to the surface of the insertion rod (22), and one end of the pulling rope (27 or 28) that is connected with the clamping piece (26) passes through the through hole (223).

6. The hoisting head (2) according to claim 1, wherein, the free end of the insertion head (23) is a coniform end (231).

7. The hoisting head (2) according to claim 1, wherein, the surface of the lifting part (21) is set with a plurality of crash-proof strips (211) that are distributed circumferentially; and two ends of the crash-proof strip (211) are fixed on the lifting part (21), and the part of the crash-proof strip (211), which is located between the two ends thereof, and the surface of the lifting part (21) form a buffer clearance (212).

8. The hoisting head (2) according to claim 7, wherein, the crash-proof strip (211) is a beryllium copper crash-proof strip.

9. A petroleum instrument hoisting system, comprising: a rope winder (3), a lifting rope (4) and a hoisting head (2); wherein, one end of the lifting rope (4) is wound on the rope winder (3), and the other end is connected with the hoisting head (2); wherein: the hoisting head (2) comprises:

a lifting part (21), for connecting a lifting rope;

an insertion rod (22), which is located under the lifting part (21) and used for protruding into the stair-shaped hoisting hole (11), and is set with a notch (221) on both sides thereof;

an insertion head (23), which is connected with the insertion rod (22) via a connecting rod (24), wherein the insertion rod (22) is set with a slide opening that is in sliding fit with the connecting rod (24), and the lateral surface of one end of the insertion rod (22) that is adjacent to the connecting rod (24) is a conical surface (222);

two clamping pieces (26), which are respectively hinged in the two notches (221), and the clamping face of the clamping pieces can be in hooking fit with the hooking face (112) in the horizontal plane, and the hinge part of the two clamping pieces (26) is located on one end thereof;

a coniform extension spring (25), which is sleeved on the insertion rod (22) and the connecting rod (24), wherein one end thereof with a large cross-sectional area is sleeved on the insertion rod (22), and the other end thereof with a small cross-sectional area is sleeved on the connecting rod (24) and is fixed relative to the connecting rod (24), wherein when the coniform extension spring (25) is in a compression state, the two clamping pieces (26) are driven in a retraction state, and the external dimension of the two clamping pieces (26) in retraction state is smaller than the diameter of the hole section of the stair-shaped hoisting hole (11) that has a small diameter;

two pulling ropes (27, 28), which are respectively connected with the other end of the corresponding clamping piece (26), wherein the pulling rope (27 or 28) is strained gradually as the clamping face rotates to the horizontal plane, and the orientations of the other ends, which are connected with the pulling rope (27 or 28), of the two clamping pieces (26) are opposite to each other.

10. The petroleum instrument hoisting system according to claim 9, wherein, the lifting rope (4) is a nylon rope.

11. The petroleum instrument hoisting system of claim 9, wherein an intermediate jointing part (29) is further included between the lifting part (21) and the insertion rod (22); and the cross-sectional areas of the lifting part (21), the intermediate jointing part (29) and the insertion rod (22) decrease gradually to form a stair-shaped structure.

12. The petroleum instrument hoisting system of claim 11, wherein the lifting part (21), the intermediate jointing part (29) and the insertion rod (22) form an integral structure.

13. The petroleum instrument hoisting system of claim 11, wherein, the intermediate jointing part (29) is set with a first through hole (291) and a second through hole (292), and the first through hole (291) and the second through hole (292) intersect with each other;

the first through hole (291) is set with a cross rod (210) that traverses the intermediate jointing part (29), the pulling rope (27 or 28) passes through the openings of the second through hole (292) that are located on the same side and is connected fixedly with the cross rod (210), and the cross rod (210) can be in stopping fit with the entrance end of the stair-shaped hoisting hole (11).

14. The petroleum instrument hoisting system of claim 9, wherein the sidewall of the notch (221) is set with a through hole (223) that extends to the surface of the insertion rod (22), and one end of the pulling rope (27 or 28) that is connected with the clamping piece (26) passes through the through hole (223).

15. The petroleum instrument hoisting system of claim 9, wherein the free end of the insertion head (23) is a coniform end (231).

16. The petroleum instrument hoisting system of claim 9, wherein the surface of the lifting part (21) is set with a plurality of crash-proof strips (211) that are distributed circumferentially; and two ends of the crash-proof strip (211) are fixed on the lifting part (21), and the part of the crash-proof strip (211), which is located between the two ends thereof, and the surface of the lifting part (21) form a buffer clearance (212).

17. The petroleum instrument hoisting system of claim 9, wherein the crash-proof strip (211) is a beryllium copper crash-proof strip.

* * * * *